US006098032A

United States Patent [19]

Brookner

[11] Patent Number: 6,098,032

[45] Date of Patent: Aug. 1, 2000

[54] SYSTEM FOR PROVIDING EARLY WARNING PREEMPTIVE POSTAL EQUIPMENT REPLACEMENT

[75] Inventor: George Brookner, Norwalk, Conn.

[73] Assignee: Ascom Hasler Mailing Systems, Inc., Shelton, Conn.

[21] Appl. No.: 08/981,659

[22] PCT Filed: Apr. 23, 1997

[86] PCT No.: PCT/US97/06837

§ 371 Date: Dec. 22, 1997

§ 102(e) Date: Dec. 22, 1997

[87] PCT Pub. No.: WO97/40480

PCT Pub. Date: Oct. 30, 1997

Related U.S. Application Data

[60] Provisional application No. 60/015,526, Apr. 23, 1996, and provisional application No. 60/043,445, Apr. 9, 1997.

[51] Int. Cl.[7] ..... G07B 17/00

[52] U.S. Cl. ..... 702/182; 702/183; 702/184; 705/410

[58] Field of Search ..... 377/13, 15, 16; 395/184.01; 702/182, 183, 184, 185, 186; 705/401, 410; 709/224; 714/47

[56] References Cited

U.S. PATENT DOCUMENTS

| | | | |
|---|---|---|---|
| 3,147,370 | 9/1964 | Lowman | 702/81 |
| 3,344,408 | 9/1967 | Singer et al. | 714/47 |
| 3,351,910 | 11/1967 | Meller et al. | 714/47 |
| 3,377,471 | 4/1968 | Althaus et al. | 395/500.27 |
| 4,234,926 | 11/1980 | Wallace et al. . | |
| 5,008,827 | 4/1991 | Sansone et al. . | |
| 5,043,908 | 8/1991 | Manduley et al. . | |
| 5,063,857 | 11/1991 | Kissel, Jr. . | |
| 5,122,976 | 6/1992 | Bellows et al. | 702/185 |
| 5,276,844 | 1/1994 | Aebi et al. . | |
| 5,581,228 | 12/1996 | Cadieux et al. | 340/146.2 |
| 5,668,973 | 9/1997 | Stutz et al. | 711/152 |
| 5,799,093 | 8/1998 | French et al. | 380/51 |

FOREIGN PATENT DOCUMENTS

| | | |
|---|---|---|
| 0442761 A2 | 8/1991 | European Pat. Off. . |
| 0516403 A2 | 12/1992 | European Pat. Off. . |
| WO 86/05611 | 9/1986 | WIPO . |
| WO 89/11134 | 11/1989 | WIPO . |

*Primary Examiner*—Edward R. Cosimano
*Attorney, Agent, or Firm*—Oppedahl & Larson LLP

[57] ABSTRACT

An improved system for providing early warning preemptive postal equipment replacement. Selected performance parameters of the postal equipment are monitored and compared against predetermined operational boundaries. The system is capable of providing for variability in the performance parameters, wherein these parameters may be permitted to vary over time and usage of the equipment. The monitoring gives an indication of the overall system performance. If the system performance goes outside of operational boundaries, or changes significantly over time, replacement of the equipment can then be scheduled with minimal inconvenience to the customer.

14 Claims, 2 Drawing Sheets

SYSTEM FOR PROVIDING EARLY WARNING PREEMPTIVE POSTAL EQUIPMENT REPLACEMENT

RELATED APPLICATIONS

This application claims priority from pending U.S. Provisional Application Ser. No. 60/015,526, filed on Apr. 23, 1996, and pending U.S. Provisional Application Ser. No. 60/043,445, filed on Apr. 9, 1997, both of which are hereby incorporated by reference.

TECHNICAL FIELD

The present invention relates generally to predicting when a device is likely to fail, and in particular to such prediction in postal equipment, such as postage meters, also called franking machines.

BACKGROUND ART

In countries such as the United States, the postal authority does not permit a customer to actually own a postage meter. Rather, the postal customer rents the postage meter from a manufacturer approved by the postal authority, such as the assignee of the present application. This meter is then used at the postal customer's facility.

In the United States, the postal customer traditionally adds postage to the meter in two ways. The first is to physically take the meter to the postal authority where postage is purchased and added to the meter. The second is to remotely add postage over the telephone line with a modem wherein the added postage is deducted from an account maintained with the meter's manufacturer.

While postal equipment in general, and postage meters in particular, are designed to be extremely reliable, on occasion a customer's meter has been known to fail. Generally speaking, there are two types of failures, catastrophic and non-catastrophic. The non-catastrophic is by far the most common of the two, and occurs when some component of the postage meter ceases to operate, such as the display, a mechanical linkage, etc. A catastrophic failure occurs when some or all of the information stored in nonvolatile memory is not recoverable, as discussed below.

The consequence of a non-catastrophic meter failure is primarily one of customer inconvenience. When such a failure occurs, the customer no longer has use of the equipment and must call for technical support. A field repair or replacement must then be scheduled, which further lengthens the "down time" of the equipment for the customer. In the case of a metering device, the failed device needs to be removed from service, the postal authority notified, and a replacement unit logged with the postal authority, and then finally provided to the customer. Depending on what component failed, certain information contained in the failed meter may be transferred to the replacement meter by the service technician.

In an electronic postage meter the amount of postage available for printing (or printed) is stored in a nonvolatile memory. It may be desirable to store the accounting data redundantly, as set forth in PCT pub. no. WO 89-11134, which is incorporated herein by reference. In addition, it may be desirable that the redundant memories be of differing technologies, as set forth in the aforementioned PCT publication. Finally, it is extremely desirable to protect the memory from harm due to processor malfunction, as set forth in U.S. Pat. No. 5,276,844, in EP pub. no. 527010, or in EP pub. no. 737944, each of which is incorporated herein by reference.

The user of an electronic postage meter should not be able to affect the stored postage data in any way other than reducing it (by printing postage) or increasing it (by authorized resetting activities). Some single stored location must necessarily be relied upon by all parties (the customer, the postal authority, and the provider of the meter) as the sole determinant of the value of the amount of postage available for printing. In electronic postage meters, the single stored location is the secure physical housing of the meter itself. Within the secure housing, one or more items of data in one or more nonvolatile memories serve to determine the amount of postage available for printing.

While a catastrophic failure is rare, the consequences of a catastrophic failure are far more severe, namely loss by the user of postage value for which the postal authority has already been paid. Furthermore, it is possible that in a catastrophic failure no information contained in the failed meter may be transferred to the replacement meter by the service technician. Thus, there is also the loss of historical data which may be of value to the customer.

SUMMARY OF INVENTION

In accordance with the present invention, there is provided a greatly improved system providing early warning preemptive postal equipment replacement. According to the invention, it is provided that selected performance parameters of the postal equipment are monitored and compared against predetermined operational boundaries. The monitoring gives an indication of the overall system performance. If the system performance goes outside of operational boundaries, or changes significantly, replacement can be scheduled with minimal inconvenience to the customer. Data from the old meter can then be orderly transferred to the replacement meter.

DETAILED DESCRIPTION OF THE INVENTION

Figure 1:
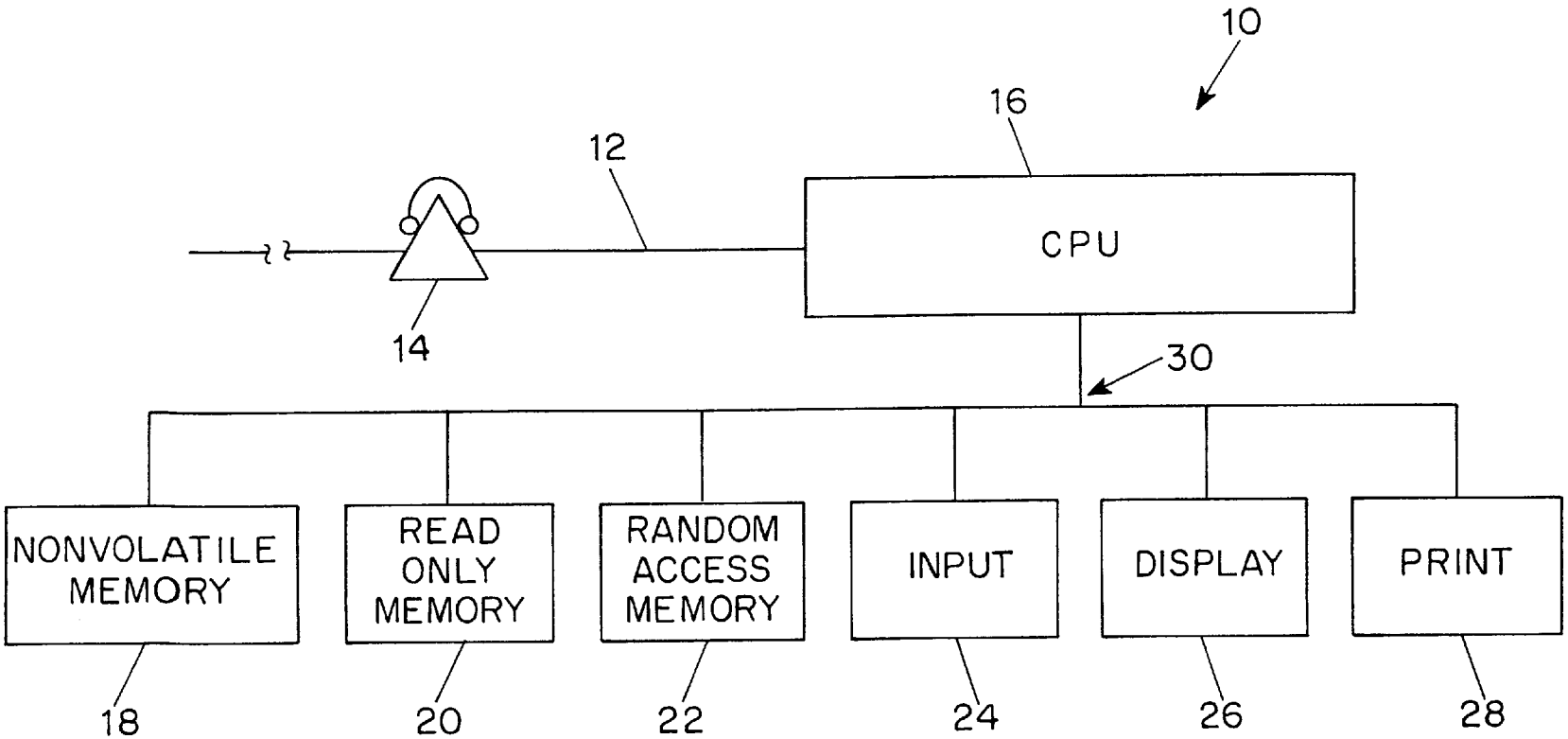
FIG. 1 is a block diagram of the system of the present invention used with a postage meter.

Referring to FIG. 1, a system in accordance with the invention is shown generally at 10, and includes a line or communications link 12 for communicating with a Data Center (not shown) used in remote resetting of postage meters having a communication device such as a telephone 14 therein, a Central Processing Unit (CPU) 16, non-volatile memory 18, read only memory (ROM) 20, random access memory (RAM) 22, input means 24, display means 26, and print means 28. The CPU 16 is connected to a Data Center through communications link or line 12. Processor 16, read only memory 18, random access memory 22, input mean 24, display means 26, and print means are coupled with each other by system bus 30. The communications link 12 may be a global communications network. The display means 26 may be a liquid crystal display or other technology capable of visually presenting computer derived information.

Figure 2:
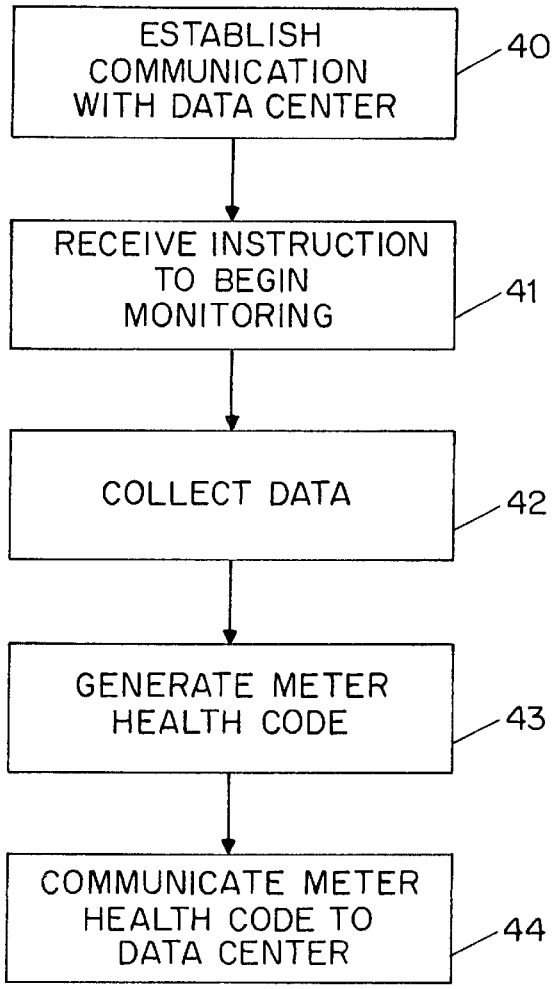
FIG. 2 is a flow chart of the method for providing early warning according to the invention.

Referring now to FIG. 2, a flow chart is shown wherein the deviation of system parameters is determined in connection with remote resetting of the meter. Generally, the meter communicates with a Data Center maintained by the meter manufacturer, which in turn communicates with a bank or other holder of funds. If funds sufficient to cover the requested amount of postage are on deposit, then that amount of postage is added to the meter. Systems for the resetting of meters remotely through the use of Data Center are known in the art. Telemeter setting (TMS) may be carried out as set forth in EPO pub. no. EP 442761, or as set forth in PCT pub. no. WO 86-05611, each of which is incorporated herein by reference.

Figure 3:
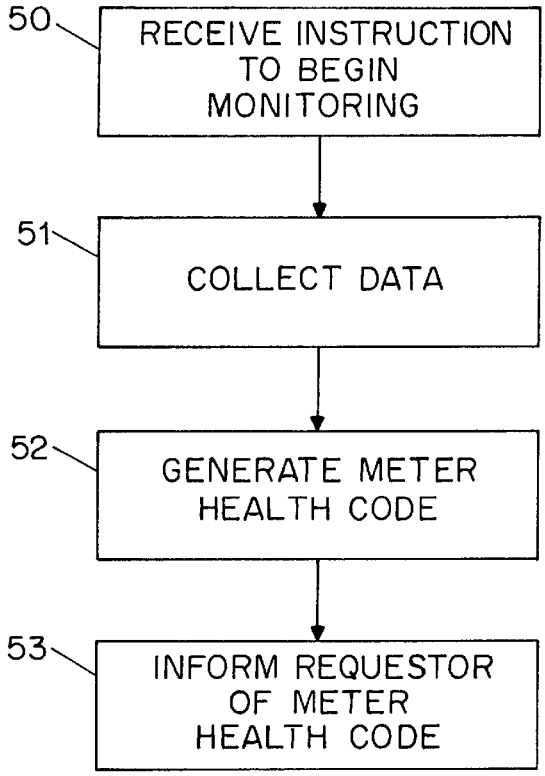
FIG. 3 is a flow chart of the method for providing early warning according to another embodiment of the invention.

Once communication has been established between processor 16 and the Data Center (FIG. 2, box 40), the processor 16 is instructed to monitor certain preselected system parameters (FIG. 2, box 41), such as motor acceleration and speed, solenoid actuation time, sensor switching time, internal diagnostic history, spare CPU band pass, non-volatile memory useable address locations remaining, display element integrity, value setting time, cycles printed, etc. (FIG. 2, box 42; FIG. 3, box 51) The motor and solenoid are typically contained in print means 28.

Processor 16 then algorithmically represents the data on the preselected system parameters through a "Metering Health Code" (MHC) (FIG. 2, box 43; FIG. 3, box 52), which periodically (for the purposes of determining the time periods between MHC generations) summarizes the performance level of the system and remains resident in the metering system, for example in non volatile memory 18. The present invention includes the capability of providing for variability in the performance measuring parameters wherein said performance monitoring parameters may be made to vary over time (e.g., aging) and usage such that it is possible and desirable to accept the performance of an older(er) product/device and yet not accept the same performance when attributed to a new product/device. The "Meter Health Code" can be stored in the postage meter and compared against predetermined parameters by the Data Center, or as preferred employment, the Data Center would also maintain a history of the postage meter's health codes and have the ability to evaluate each postage meter against its own health code degradation. In this manner, a postage meter which is degrading very slowly can be left in service longer than a postage meter that shows a more rapid degradation pattern. Another preferred embodiment of this invention is to execute a benchmark evaluation of the postage meter at the time of manufacture, said benchmark would reside within the postage meter memory as well as within the Data Center's history file applied to that specific postage meter.

The "Metering Health Code" is then communicated to the Data Center (FIG. 2, box 44) where it is evaluated to determine if the meter is a candidate for replacement. Such evaluation need not occur during the communication with the meter, but may occur at another time. Alternatively, such evaluation may occur within the meter itself, with the result of the evaluation being transmitted to the Data Center.

Rather than generate the "Meter Health Code" in the meter, and communicate the result to the Data Center for evaluation, alternatively the parameters underlying the "Metering Health Code" may be communicated to the Data Center and the "Metering Health Code" will be determined and evaluated at the Data Center.

Evaluation of the "Meter Health Code" assures the system is performing within acceptable boundaries at the time the "Meter Health Code" is determined. Furthermore, monitoring changes system performance over time is beneficial. Even if overall system performance at a given point in time is within acceptable boundaries, a change in the "Metering Health Code" would signal a need to monitor the system closely or to perform preventative maintenance, or in the case of a meter, replace it prior to a failure resulting in "down time" for the customer.

With an early warning of impending failure, a replacement can be scheduled with no inconvenience to the customer. The physical exchange could be made during a period of non-use by the customer. Furthermore, the customer's accounting and historical system information maintained within the customer's meter can be reconfigured into the new meter via modem at the time the new meter is "logged" into the Data Center. For example, said customer-use specific accounting and historical data (from the customer's existing meter) would be uploaded to the Data Center prior to meter replacement. When the new meter "logs" on with the Data Center, said customer data is downloaded into the replacement meter. The customer is now able to continue system usage without any of his customer-specific data having been changed.

Referring now to FIG. 3, a flow chart is shown wherein the generation of "Meter Health Code" occurs in response to an input from other than the Data Center during funds recharging. In this embodiment of the invention, the process of the present invention is commenced in response to the appropriate command (FIG. 3, box 50) given during a routine inspection via the modem or keyboard/display by entering a code which extracts and transmits the quantitative performance data to the Data Center or displays/prints the quantitative performance data to the user (FIG. 3, box 53).

While there have been described what are believed to be the preferred embodiments of the invention, those skilled in the art will recognize that other and further modifications may be made thereto without departing from the invention and it is intended to claim all such changes and modifications as fully within the scope of the invention.

I claim:

1. A system for use with postal equipment, comprising:

means for communicating with a Data Center;

processor means for monitoring selected system parameters of said postal equipment responsive to a communication from said Data Center;

means for summarizing said selected system parameters to reflect the performance level of the system;

means for communicating said summarized performance level of the system to said Data Center.

2. The system as described in claim 1, wherein said means for communicating with a Data Center is a modem.

3. The system as described in claim 1, wherein said means for communicating with a Data Center is a global communications network.

4. A system for use with postal equipment, comprising:

means for communicating with a Data Center;

processor means for monitoring selected system parameters of said postal equipment responsive to a communication from said Data Center;

means for summarizing said selected system paramaters to reflect the performance level of the system;

means for communicating said summarized performance level of the system to determine if replacement of the postal equipment is warranted.

5. The system as described in claim 4, wherein said means for communicating with a Data Center is a modem.

6. The system as described in claim 4, wherein said means for communicating with a Data Center is a global communications network.

7. A system for use with postal equipment, comprising:

processor means for monitoring selected system parameters of said postal equipment;

means for summarizing said selected system parameters to reflect the performance level of the system;

means for communicating said summarized performance level of the system to a user of the system.

8. The system as described in claim 7, wherein said means for communicating said summarized performance level of the system to a user of the system is a liquid crystal display or other technology capable of visually presenting computer derived information.

9. A system for use with postal equipment, comprising;

processor means for monitoring selected system parameters of said postal equipment;

means for summarizing said selected system parameters to reflect the performance level of the system;

memory means for storing said summarized performance level of the system.

10. A method for use with postal equipment, comprising:

communicating with a Data Center;

monitoring selected system parameters of said postal equipment responsive to a communication from said Data Center;

summarizing said selected system parameters to reflect the performance level of the system;

communicating said summarized performance level of the system to said Data Center;

evaluating said summarized performance level of the system to determine if replacement of the postal equipment is warranted.

11. A method for use with postal equipment, comprising:

monitoring selected system parameters of said postal equipment;

summarizing said selected system parameters to reflect the performance level of the system;

evaluating said summarized performance level of the system to determine if replacement of the postal equipment is warranted.

12. A method for use with postal equipment, comprising:

monitoring selected system parameters of said postal equipment;

summarizing said selected system parameters to reflect the performance level of the system;

communicating said summarized performance level of the system to a user of the system.

13. A method for use with postal equipment, comprising:

monitoring selected system parameters of said postal equipment;

summarizing said selected system parameters to reflect the performance level of the system;

storing said summarized performance level of the system.

14. The method as described in claim 13, wherein said monitoring is performed periodically.

* * * * *